US005434759A

United States Patent [19]

Endo et al.

[11] Patent Number: 5,434,759

[45] Date of Patent: Jul. 18, 1995

[54] SAFETY INDICATING DEVICE

[76] Inventors: Osamu Endo; Nobuo Matsukawa; Sigeru Kuwahara; Yasuo Nakamura, all c/o Koito Manufacturing Co., Ltd., Shizuoka Works, 500, Kitawaki, Shimizu-shi, Shizuoka, Japan

[21] Appl. No.: 137,988

[22] Filed: Oct. 19, 1993

[30] Foreign Application Priority Data

Oct. 20, 1992 [JP] Japan ..... 4-078975 U
Sep. 24, 1993 [JP] Japan ..... 5-261721

[51] Int. Cl.[6] ..... F21L 15/08

[52] U.S. Cl. ..... 362/108; 362/103; 362/800; 362/252

[58] Field of Search ..... 362/800, 105, 103, 108, 362/253, 806, 235, 241, 84, 237, 240, 247, 248, 252; 2/338

[56] References Cited

U.S. PATENT DOCUMENTS

| | | | |
|---|---|---|---|
| 3,944,803 | 3/1976 | Chao | 362/108 |
| 4,080,085 | 3/1978 | Dickson | 362/235 |
| 4,164,008 | 8/1979 | Miller et al. | 368/800 X |
| 4,570,206 | 2/1986 | Deutsch | 362/800 X |
| 4,602,191 | 7/1986 | Davila | 362/103 X |
| 4,709,307 | 11/1987 | Branom | 362/800 X |
| 4,774,434 | 9/1988 | Bennion | 362/103 X |
| 4,774,642 | 9/1988 | Janko et al. | 362/103 X |
| 5,029,046 | 7/1991 | Kameda | 362/84 |
| 5,128,843 | 7/1992 | Guritz | 362/103 |
| 5,245,516 | 9/1993 | de Hass et al. | 362/84 X |
| 5,278,734 | 1/1994 | Ferber | 362/103 |

FOREIGN PATENT DOCUMENTS 8609636 10/1993 Germany .

*Primary Examiner*—Ira S. Lazarus
*Assistant Examiner*—Thomas M. Sember
*Attorney, Agent, or Firm*—Sughrue, Mion, Zinn, Macpeak & Seas

[57] ABSTRACT

A safety indicating device having a flexible indicator body and a power source unit. The indicator body has a transparent protective sheet which is disposed on the back side of a front sheet having a plurality of windows and on which projections corresponding to the windows are formed, and a flexible substrate which is disposed on the back side of the transparent protective sheet and on which LEDs are fixedly arranged in a manner corresponding to the projections. The transparent protective sheet and the flexible substrate are stacked and adhered to each other. A waterproof lining sheet is closely adhered to the back of the flexible substrate.

27 Claims, 12 Drawing Sheets

SAFETY INDICATING DEVICE

BACKGROUND OF THE INVENTION

The present invention relates to a self-luminous safety indicating device which can be attached to the clothing or the body of the user and functions to provide a warning to drivers of automobiles, bicycles, or other vehicles (hereinafter, referred to collectively as "vehicles").

Conventionally, for indicating the presence of a pedestrian or a worker along a road at night to drivers of vehicles passing along the road, thereby preventing an accident from occurring, a self-luminous indicating device designed to be attached to the clothing or body of the user has been proposed (See for example, Unexamined Japanese Utility Model publication (Kokai) No. Sho. 62-9289.) In the proposed indicating device, as shown in FIGS. 28 and 29, a flexible indicating plate 53 is provided on its surface with a light reflecting unit 50 and a luminous indicator 52. The luminous indicator 52 is constructed of a plurality of light emitting devices 51 such as light emitting diodes, or light emitting chips (hereinafter, such light emitting devices are referred to as "LEDs"). The indicating plate 53 is combined with a belt 54. The belt 54 is wound around the arm of a pedestrian or a worker so that the indicating plate 53 is fixed thereto. The indicating plate 53 is powered by a power source unit 55 to emit light, and it may also reflect light, so that the presence of the pedestrian or the worker is indicated to drivers of vehicles, thereby ensuring the safety of the pedestrian or the worker.

However, a prior art indicating device of this type has problems as described below. The LEDs 51 are arranged on the surface of a flexible substrate 56, and the surface of the flexible substrate 56 is covered in such a manner that the light emitting portions of the LEDs are exposed. The back of substrate 56 is covered by the surface of the belt 54 itself. This configuration necessitates that the indicating plate 53 and the belt 54 only be used in combination. Accordingly, there arises a problem in that the indicating plate 53 and the belt 54 cannot be used while being separated from each other, so that they, particularly the indicating plate 53, cannot be used in another manner or for other purposes. Furthermore, when the indicating device is attached to the arm of a user, the indicating device is located only on the one side of the arm of the user to which the device is attached, and the warning indication is provided only on that one side. This causes another problem in that the indicating device is inferior in visibility for drivers of vehicles which approach the user in various directions.

SUMMARY OF THE INVENTION

The present invention has been made in view of the above problems. It is an object of the invention to provide a safety indicating device which is constructed so that an indicator body can be detached freely from a belt, thereby enabling the user to attach the detached indicator body to a portable article and use it for various purposes, and in which the indicator body is flexible and formed in a belt-like shape so as to be attached to the article while bending or folding in the circumferential direction of the article so that the indicator is directed over a wide angle, thereby improving visibility for drivers of vehicles which approach the user in various directions.

In order to accomplish the above-mentioned object, the safety indicating device of the invention comprises a flexible indicator body which incorporates a plurality of light emitting diodes (LEDs) emitting light toward a surface, and a power source unit for supplying electric power to the LEDs, wherein the indicator body comprises: a transparent protection sheet disposed on the back side of a front cloth having a plurality of windows, and in which projections corresponding to the windows are formed; a flexible substrate disposed in the back side of the transparent protection sheet and on which the LEDs are fixedly arranged at positions corresponding to the projections, the transparent protection sheet and the flexible substrate being stacked and adhered to each other; and a waterproof lining cloth closely adhered to the back of the flexible substrate.

A belt holder through which a belt for securing the indicator body to the clothes or body of the user may be arranged on the back side of the indicator body.

According to the above configuration, the user can suitably attach the safety indicating device to the user's waist or a carried article, and selectively set the device to steadily emit light or flash, whereby the visibility for drivers of vehicles with respect to the user can be improved. Moreover, since the indicator body can be attached to the waist or arm of the user while being conformed to the cylindrical shape of the waist, arm or the like, visibility can be established in the range of 180 degrees, thereby contributing to road safety at night.

DESCRIPTION OF THE PREFERRED EMBODIMENTS

Hereinafter, embodiments of the safety indicating device of the invention will be described with reference to the drawings. The safety indicating device of the invention can be used while being attached to a cylindrical portion of the waist, arm or the like of the user, or to a portion of an article carried by the user, such as the surface of a waist pack or a shoulder strap of a satchel.

Figure 1:
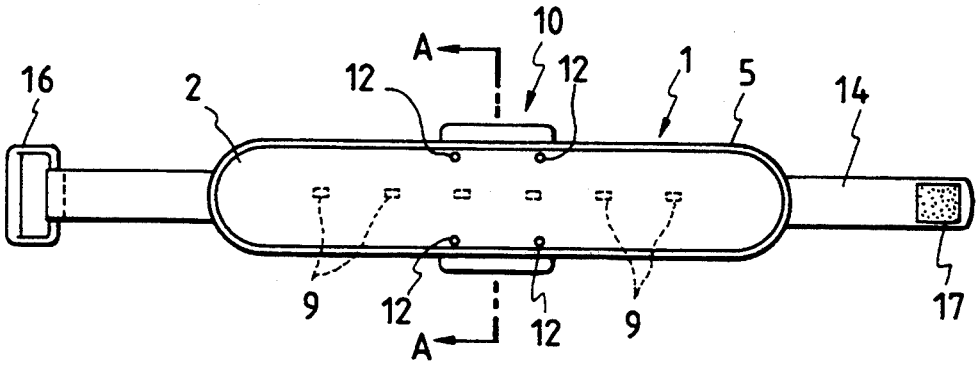
FIG. 1 is a front view showing a first embodiment of the safety indicating device of the invention.
Figure 2:
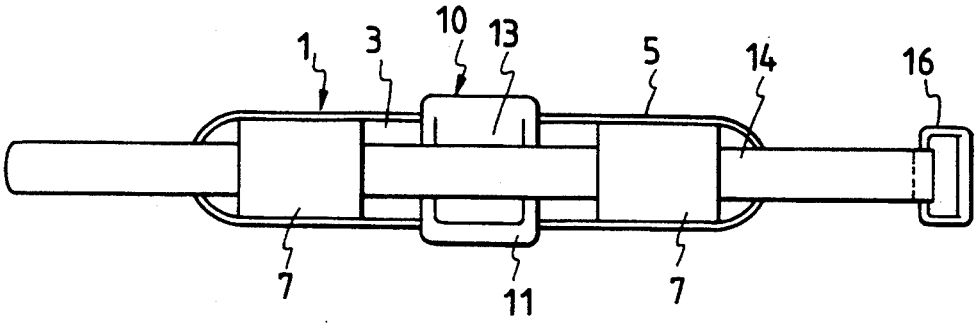
FIG. 2 is a rear view of the embodiment.
Figure 3:
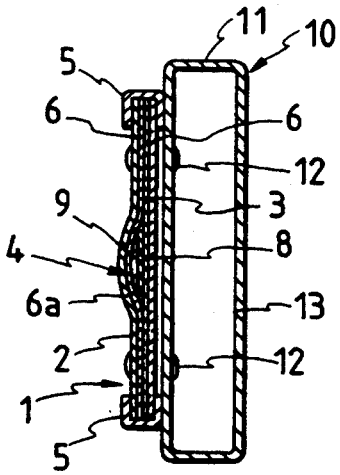
FIG. 3 is an enlarged section view taken along the line A—A in FIG. 1.
Figure 4:
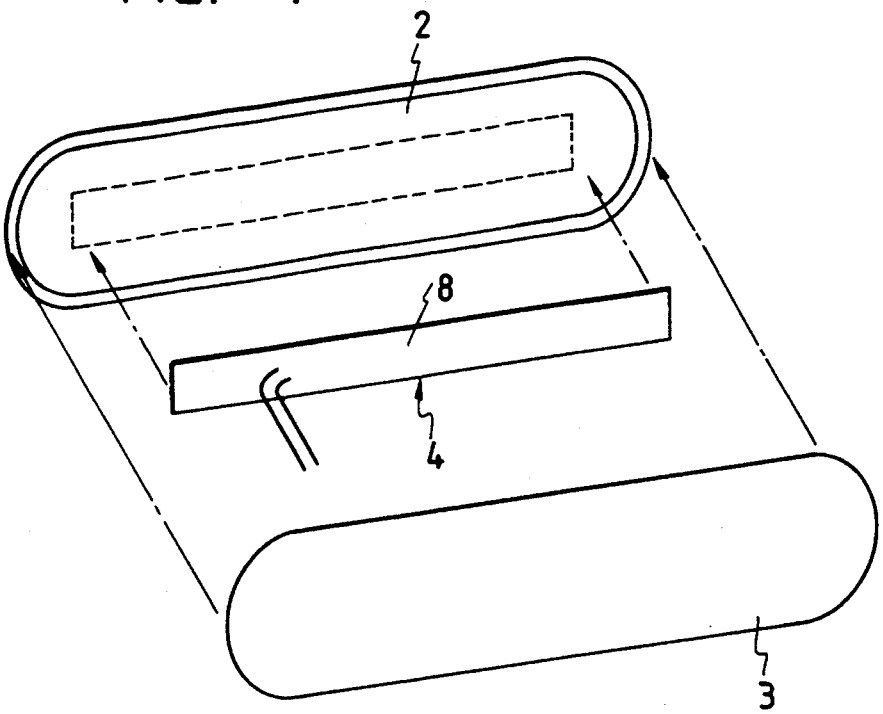
FIG. 4 is an exploded perspective view showing the overall configuration of an indicator body.
Figure 5:
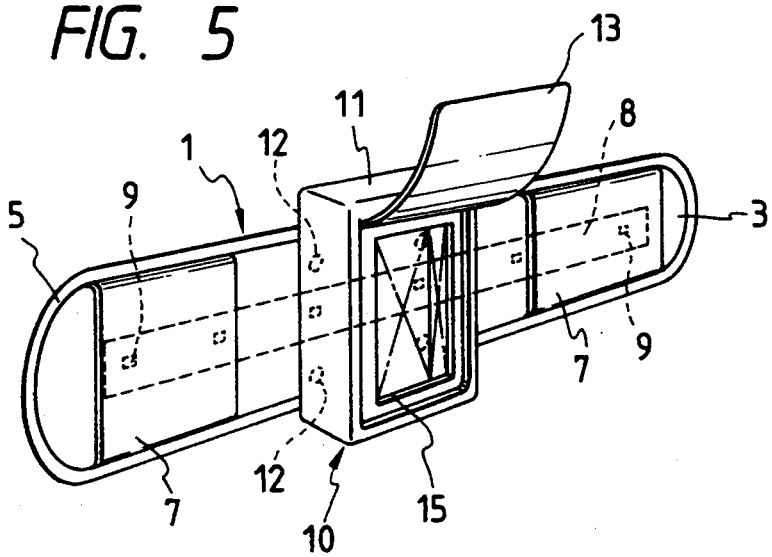
FIG. 5 is a perspective view of a power source unit as seen from the rear side.

FIG. 1 is a front view showing a first embodiment of the safety indicating device of the invention, FIG. 2 is a rear view of the embodiment, FIG. 3 is an enlarged cross-sectional view taken along the line A—A in FIG. 1, FIG. 4 is an exploded perspective view showing the overall configuration of the indicator body, and FIG. 5 is a perspective view of a power source unit as seen from the rear side.

In the figures, an indicator body 1 is constructed in the following manner: A light emitting body 4 is interposed between front sheet 2 and lining sheet 3 (FIG. 4), which sheets are preferably formed of a cloth material, and then the peripheral portions of the front sheet 2 and the lining sheet 3 are stacked. The peripheral portions are covered by trimming sheet 5 and sewn together in a tubular configuration so that the light emitting body 4 is hermetically sealed therein. If desired, the front sheet 2 may be modified by applying a fluorescent material thereto, or by printing a desired pattern on at least its surface, so that the front sheet 2 itself is made more attractive and more readily visible at night.

Transparent protective sheets 6 made of transparent polyvinyl chloride or the like are suitably interposed between the inner faces of the front sheet 2 and the lining sheet 3 so as to cover substantially the entire region of their inner faces. The faces of the sheets contacting the front sheet 2 and the lining sheet 3 are adhered thereto such as with an adhesive agent or a double-sided adhesive tape, and the peripheral portions of the sheets are sewn so as to be fixed to those of the front sheet 2 and the lining sheet 3. This configuration can enhance the waterproofing of the light emitting body 4 in the indicator body 1 against atmospheric moisture and sweat from the front and back faces.

Moreover, on the back of the indicator body 1 or on the lining sheet 3, there are provided two belt holders 7 located at positions which are substantially symmetrical in the lateral direction. The front sheet 2 and the lining sheet 3 may be made of a waterproof material such as a polyvinyl chloride sheet material or the like so that rainwater or other moisture is prevented from penetrating into the indicator body 1, and the adhesion properties for a battery box (which will be described later) are enhanced.

The light emitting body 4 is constructed in such a manner that a plurality of very high brightness LEDs 9, which are usually of the chip type, are suitably fixed in parallel to a flexible substrate 8. The steady or flashing light from light emitting body 4 is directed toward the surface side through the transparent protective sheet 6 having a projection 6a which is formed so as to cover the LEDs 9, and a light transmission portion (window portion) of the front sheet 2, whereby the presences of the user is clearly indicated. Reference numeral 10 designates a power source unit which supplies electric power to the light emitting body 4, and which includes a switch for conducting ON/OFF control of the light emitting body 4. The power source unit 10 has a configuration wherein a case 11 made of a sheet or thick synthetic resin material such as vinyl "leathercloth" is fixed to the back of the indicator body 1 by a plurality of rivets 12, and a lid 13, which can be opened toward the back side, covers the inside of the case.

In the above embodiment, the lid 13 is formed by cutting the back of the case 11 made of cloth or the like along an inverted substantially U-like shape. By pulling up the lid 13 formed by the U-like cut portion toward the uncut portion (the upper portion in the figure), the inside of the case 11 can be opened (see FIG. 5). When the case 11 is sandwiched between the back of the indicator body 1 and a belt 14 (which will be described later), the lid 13 is usually prevented from being opened toward the back side (see FIG. 2). Therefore, it is not required to particularly dispose fixing means for fixing the lid 13 to the case 11. If desired, fixing means such as a hook may suitably be provided. The battery box 15, and a driving circuit (not shown) including a flash circuit are housed in the case 11.

The belt 14 is usually passed through the belt holders 7 formed on the back of the indicator body 1, so as to be detachably held to the indicator body. Generally, the belt 14 may be made of an elastic cloth material such as rubber, and has a length which allows the belt to be wound around the outer periphery of an object to which the present device is to be attached (hereinafter, such an object is referred to as "attached object"), such as cylindrical portion of the arm or the waist of the user. In the above embodiment, the belt 14 is provided at one end with a buckle 16, and at the other end with a fixing means 17 such as Velcro tape. After the belt 14 is wound around the attached object, therefore, both ends can be joined together so that the safety indicating device is prevented from falling off the attached object.

It is needless to say that the fixing structure of the buckle 16 and the fixing means 17 is not restricted to the particular arrangement discussed above. (In the same manner as the belt used in a fifth embodiment which will be described later, the fixing structure may be configured so that a convex Velcro tape 14a is disposed at one end of the belt, and a concave Velcro tape 14b engaging with the convex tape 14a is disposed at the other end.)

Figure 6:
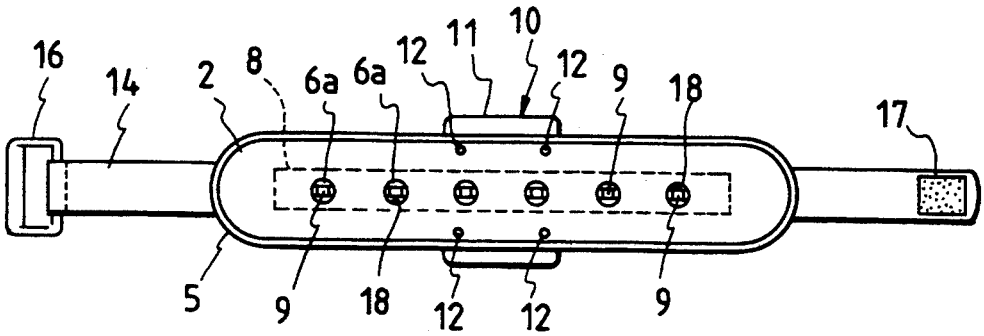
FIG. 6 is a front view showing a second embodiment of the safety indicating device of the invention.
Figure 7:
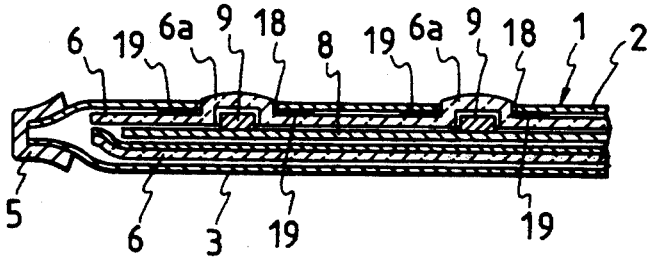
FIG. 7 is an enlarged cross-sectional view of main portions of the second embodiment.
Figure 8:
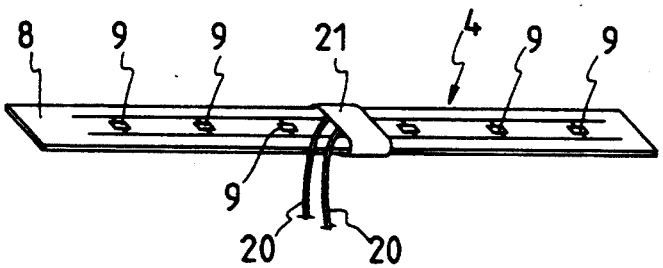
FIG. 8 is a perspective view showing an example of the configuration of a light emitting body.

FIGS. 6 to 8 show a second embodiment of the safety indicating device of the invention. Hereinafter, portions of the embodiment different from those of the first embodiment will be described.

In the second embodiment, windows 18 are opened at portions of the front sheet 2 of the indicator body 1 which correspond to the LEDs 9, and the transparent protective sheet 6 covering the surface of the flexible substrate 8 is formed in a shape in which portions 6a corresponding to the windows 18 project toward the surface of the device so that the LEDs 9 located inside the projections 6a are exposed in respective ones of the windows 18 of the front sheet 2.

In this configuration, light emitted from the LEDs 9 is directly radiated from the surface of the indicator body 1, so that the brightness of the LEDs 9 to the outside is enhanced and the luminous visibility is improved. The inner peripheral portion of each of the windows 18 is fixed to the transparent protective sheet 6 with an adhesive member 19 such as a double-sided adhesive tape, thereby preventing the inner peripheral portion from being lifted up with respect to the transparent protective sheet 6. A power cord 20 is soldered to the flexible substrate 8, and the soldered portion is covered with a tape 21 to prevent problems such as breakage of the power cord 20 from occurring (see FIG. 8). The insulation cover of the power cord 20 is a material of a light color such as white or yellow so that the power cord 20 cannot be seen through the front sheet 2 and the lining sheet 3.

Figure 9:
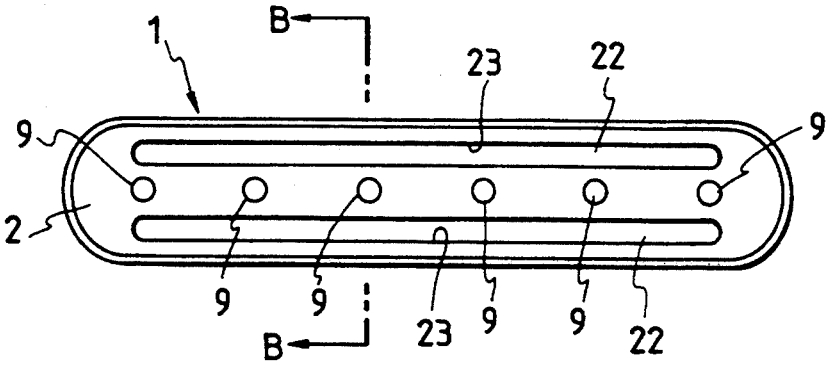
FIG. 9 is a front view showing an indicator body used in a third embodiment of the safety indicating device of the invention.
Figure 10:
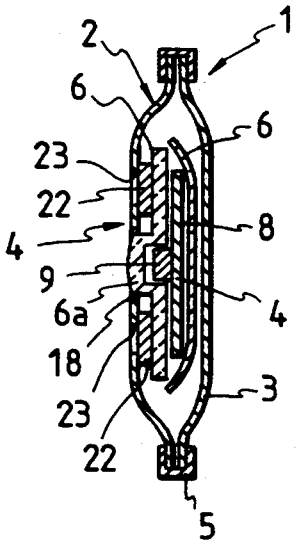
FIG. 10 is an enlarged section view taken along the line B—B in FIG. 9.

FIGS. 9 and 10 show a third embodiment of the safety indicating device of the invention.

In the third embodiment, reflectors 22 are attached to the front sheet 2 of the indicator body 1 of the second embodiment, thereby improving the reflection for external light. More specifically, in this embodiment, the reflectors 22 are located inside openings 23. The openings 23 are formed in the front sheet 2 in such a manner that they are on both sides of the LEDs 9 arranged laterally in one row in the longitudinal direction of the flexible substrate 8 housed in the indicator body 1, separated from the row of the LEDs 9 by a given distance.

This configuration allows the reflective power of the reflectors 22 to be effectively used without impairing the visibility of the LEDs 9 (when the reflectors 22 are located at positions proximate to the LEDs 9, the reflective power of the reflectors 22 tends to make the lighting of flashing or the LEDs 9 difficult to see).

Figure 11:
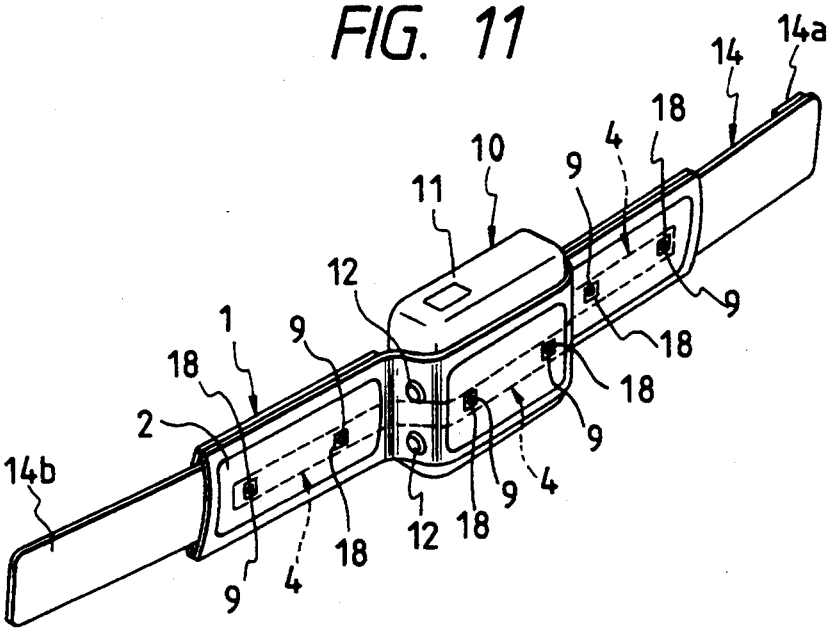
FIG. 11 is a front perspective view showing a fourth embodiment of the safety indicating device of the invention.
Figure 12:
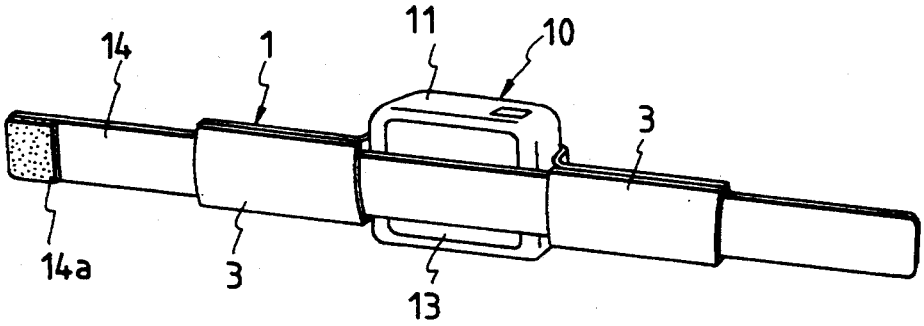
FIG. 12 is a rear perspective view of the fourth embodiment.
Figure 13:
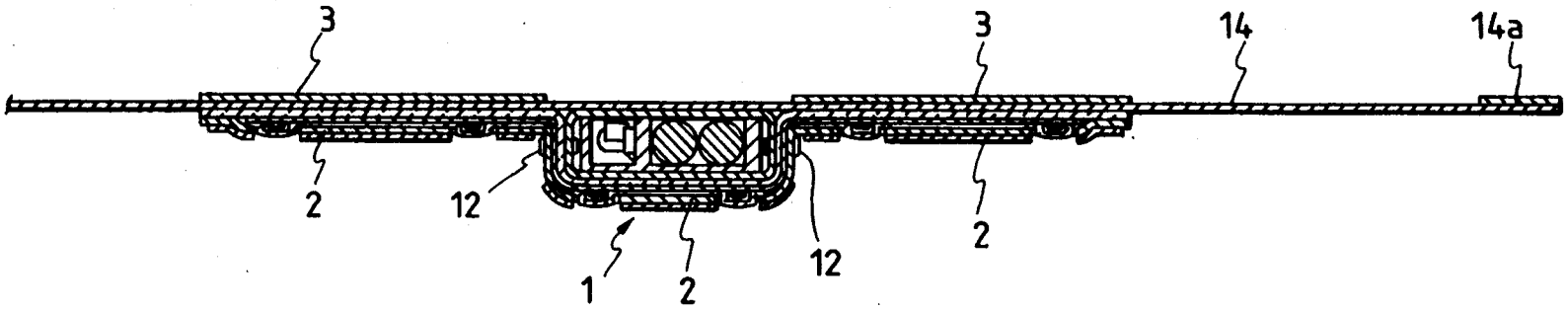
FIG. 13 is an enlarged cross-sectional view of main portions of the fourth embodiment.

FIGS. 11 to 13 show a fourth embodiment of the safety indicating device of the invention. Hereinafter, portions of the embodiment different from those of the first to third embodiments will be described.

In the fourth embodiment, the front sheet 2 constituting the indicator body 1 is disposed on the surface side of the case 11 of the power source unit 10 which has a given thickness, or bent to conform to the shape of the surface and side faces of the case 11, and fixed to the lateral side faces of the case 11 by means of rivets 12 or the like, thus making the back of the indicator body 1 substantially flush with the back of the case 11. The lining sheet 3 spreads over the back portions of the indicator body 1 which are respectively located at both lateral sides of the case 11. The flexible substrate 8, the back of which is covered by the transparent protective sheet 6, is mounted along the surface of the case 11 so that the LEDs 9 arranged on the surface of the protection sheet 6 are directed to the surface side of the indicator body 1.

The lining sheet 3 is sewn on and fixed to the front sheet 2 only at the upper and lower portions as viewed in FIGS. 11 and 12, so that a gap extending in the lateral longitudinal direction of the indicator body 1 can be formed between the front sheet 2 and the lining sheet 3, thereby enabling the belt 14 to pass through the gap. The belt 14 is secured to the indicator body 1 by adequately fixing the belt to one of the lateral sides of the case 11. When the portion of the belt 14 which is on the unfixed side is pulled out toward the back side of the case 11, the lid 13 of the case 11 constituting the power source unit 10 can be opened. A fixing member such as convex Velcro tape 14a is attached to one end of the belt 14, and another fixing member such as concave Velcro tape 14b engaging with the convex Velcro tape 14a is attached to other end of the belt.

Figure 14:
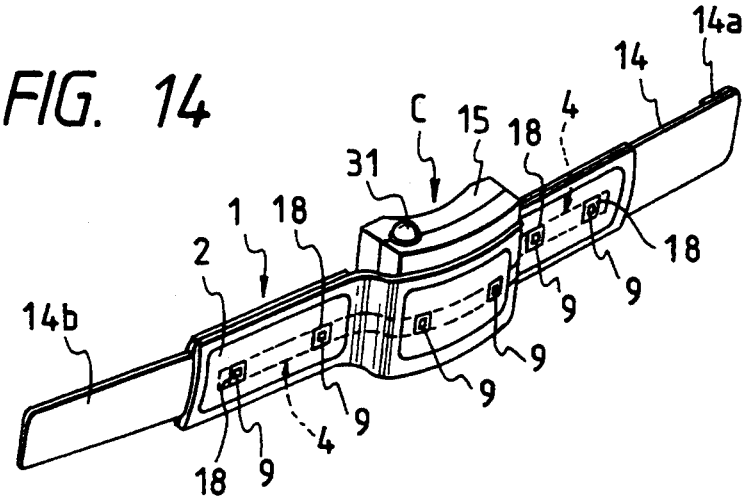
FIG. 14 is a front perspective view showing a fifth embodiment of the safety indicating device of the invention.
Figure 15:
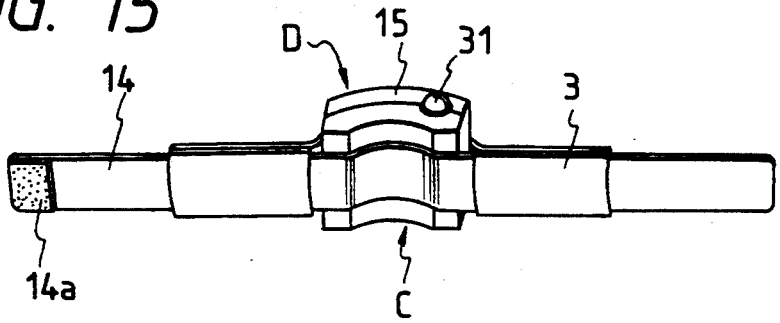
FIG. 15 is a rear perspective view of the fifth embodiment.
Figure 16:
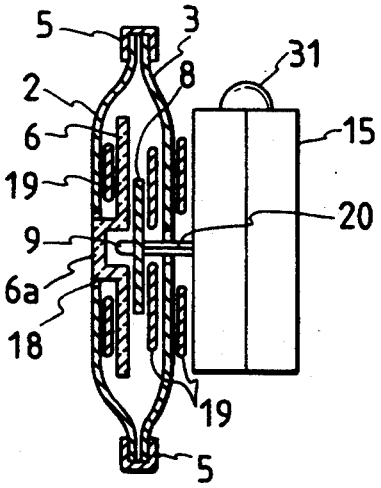
FIG. 16 is an enlarged cross-sectional view of main portions of the embodiment.
Figure 17:
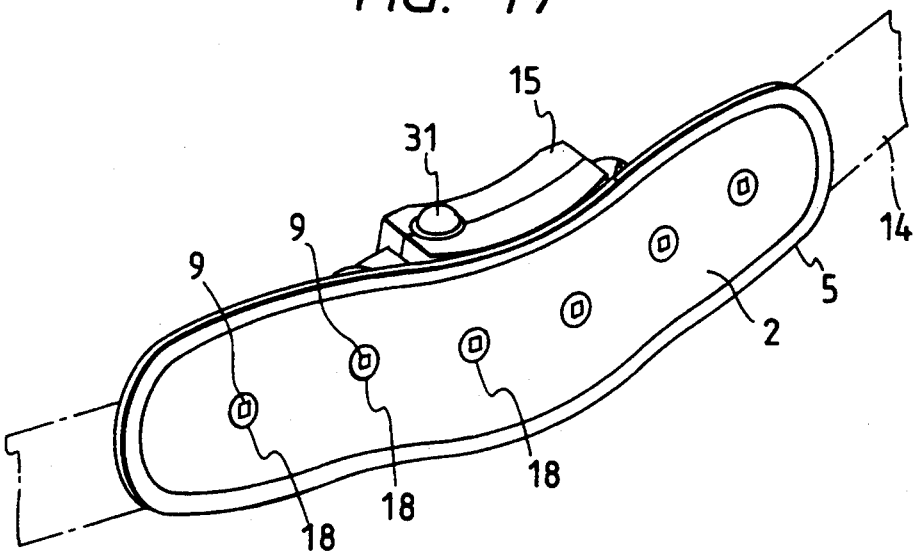
FIG. 17 is a front perspective view showing a sixth embodiment of the safety indicating device of the invention.
Figure 18:
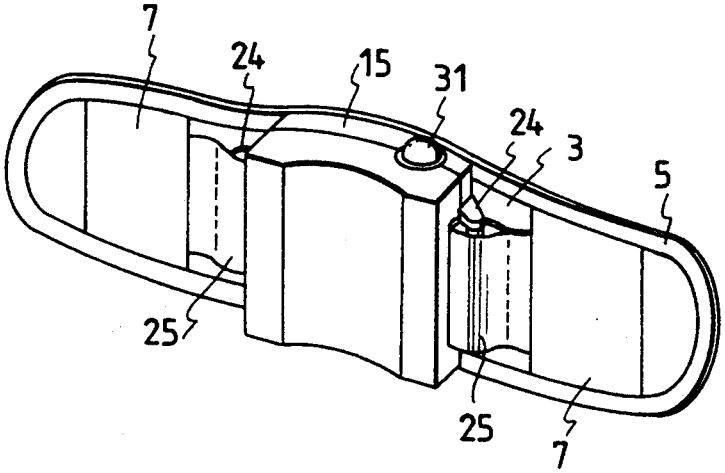
FIG. 18 is a rear perspective view of the sixth embodiment.
Figure 19:
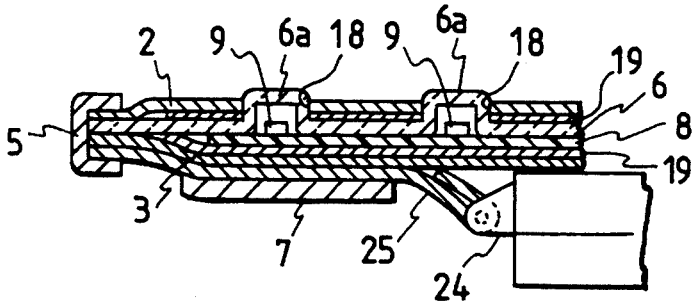
FIG. 19 is an enlarged cross-sectional view of main portions of the sixth embodiment.
Figure 20:
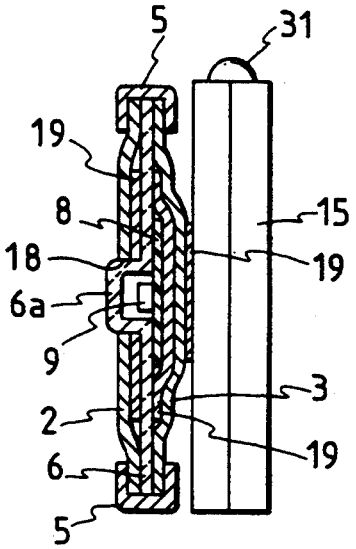
FIG. 20 is an enlarged cross-sectional view of main portions of the sixth embodiment.

FIGS. 14 to 16 show a fifth embodiment of the safety indicating device of the invention. The fifth is embodiment is a modification of the fourth embodiment. Hereinafter, portions of the fifth embodiment different from those of the fourth embodiment will be described.

In the fifth embodiment, the front sheet 2 constituting the indicator body 1 is bent to conform the shape of the surface and side faces of the battery box 15, which has a given thickness, and fixed to the back of the battery box 15 by adhesive members 19 such as double-side adhesive tapes, while making the back of the indicator body 1 substantially flush with the back of the battery box 15. The lining sheet 3 spreads over the back portions of the indicator body 1 located at both lateral sides of the battery box 15. The battery box 15 used in the fifth embodiment is formed with its surface and back shapes conforming to the shape of the attached object such as the body of the user. Namely, in a cross section of the battery box 15, the surface has a convex arcuate shape (see the portion indicated by the arrow C), and the back has a convex arcuate shape (see the portion indicated by the arrow D), so that, when the device is used, the surface of the indicator body 1 has a natural attached state.

Also in the embodiment, the lining sheet 3 is sewn on and fixed to the front sheet 2 only at the upper and lower portions, so that a gap extending in the lateral longitudinal direction of the indicator body 1 can be formed between the front sheet 2 and the lining sheet 3, thereby enabling the belt 14 to pass through the gap.

In the fifth embodiment, the flexible substrate 8 interposed between the front sheet 2 and the lining sheet 3, and the transparent protective sheet 6 covering the plurality of LEDs 9 arranged in one row on and fixed to the surface of the flexible substrate 8 are closely adhered to the inner faces of the lining sheet 3 and the front sheet 2 by adhesive members 19 such as double-sided adhesive tapes. The battery box 15 is fixedly adhered by adhesive members 19 to the back of the lining sheet 3, which is made of a white polyvinyl chloride sheet. The power cord 20 extending from the substrate 8 is directed through the lining sheet 3 into the battery box 15 to be connected thereto. Alternatively, the transparent protective sheet 6 may be adhered to the lining sheet 3 by thermal welding.

According to this configuration, it is possible to omit the case 11 for accommodating the battery box 15, whereby the overall configuration of the safety indicating device can be simplified.

FIGS. 17 to 21 show a sixth embodiment of the safety indicating device of the invention. The sixth embodiment is a modification of the fifth embodiment. Hereinafter, portions of the sixth embodiment different from those of the fifth embodiment will be described.

In the sixth embodiment, the indicator body 1 includes the transparent protective sheet 6 which is disposed in the back side of the front sheet 2 in which a plurality of windows 18 are formed and in which the projections 6*a* corresponding to the windows 18 are formed, and the flexible substrate 8 which is disposed in the back side of the transparent protective sheet 6 and on which the LEDs 9 are arranged so as to respectively correspond to the projections 6a. The front sheet 2 and the flexible substrate 8 are adequately adhered to each other by the adhesive members 19. The lining sheet 3 which is made of a waterproof white polyvinyl chloride sheet material is closely adhered to the back of the flexible substrate 8. An engaging portion 24 is formed at each of the lateral sides of the battery box 15. Two fixing cloth pieces 25, which are respectively engaged at one end with engaging portions 24 formed at the lateral sides of the battery box 15, extend over the back of the lining sheet 3 so that the battery box 15 is hooked to the back of the indicator body 1. The other end of each of the fixing cloth pieces 25 is sewn on and fixed to the front sheet 2, the transparent protective sheet 6 and the lining sheet 3 through the trimming cloth 5.

Figure 21:
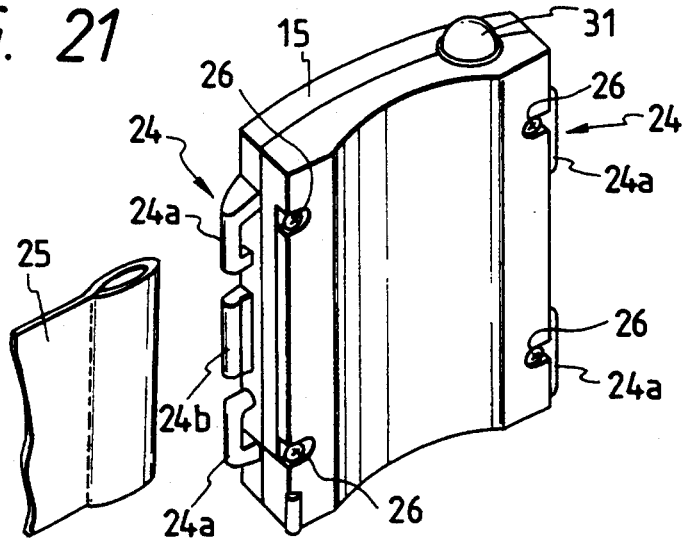
FIG. 21 is an enlarged perspective view showing the configuration of a battery box.

In the sixth embodiment, each of the engaging portions 24 is formed by a pair of engaging pieces 24*a* which respectively protrude from upper and lower ends of one side of the battery box 15 so as to oppose each other, and a positioning rib 24*b* formed between the pair of the engaging pieces 24*a* (see FIG. 21). Each of the engaging pieces 24*a* is inserted into the one end of the respective fixing cloth piece 25 which is formed in a tubular shape, and engaged therewith. Further, the battery box 15 is divided into two sections facing the front and back sides of the body 1 and which are connected to each other so as to form an integral unit by rear screws 26. The battery box 15 is secured onto the back of the lining sheet 3 by the adhesive members 19, thereby to prevent the battery box 15 from working down or the like during use.

The belt holders 7 are sewn on and fixed to the back portions of the fixing cloth pieces 25 on both sides of the battery box 15. The belt holders 7 also have the function of continuously pressing the fixing cloth pieces 25 against the lining sheet 3 so that the fixing cloth pieces 25 are united with the indicator body 1.

Figure 22:
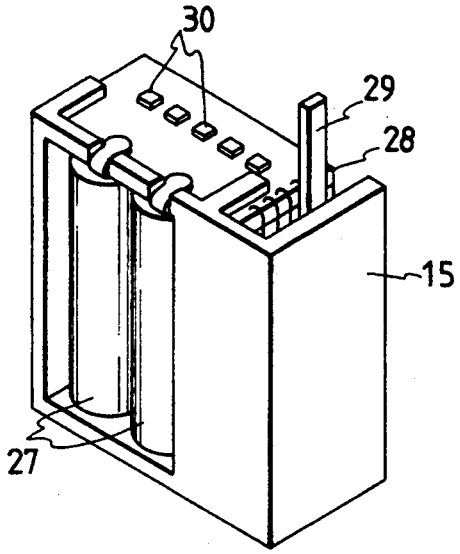
FIG. 22 is a rear perspective view showing an example of the configuration of the battery box which is to be incorporated in a case of a power source unit.
Figure 23:
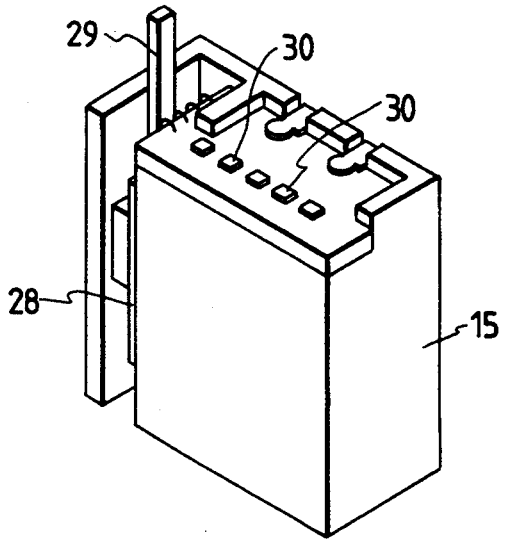
FIG. 23 is a front perspective view showing the example of FIG. 22.

FIG. 22 is a rear perspective view showing an example of the configuration of the battery box 15 to be incorporated in the case 11 of the power source unit 10, and FIG. 23 is a front perspective view showing the example. In these figures, the power source unit 10 is configured so that the case 11 is made of a material such as vinyl leathercloth which is thick and somewhat hard, the battery box 15 accommodating one or more dry batteries 27 is fitted into the back of the case 11, and a driving circuit 28 including a flasher circuit is disposed at the side portion of the battery box 15. The ON/OFF operation of the power source unit is conducted through a main switch 29 which is of the push ON/-OFF type and disposed in the driving circuit 28.

Various operation buttons 30 may be disposed on the upper face of the battery box 15. In the configuration wherein the battery box 15 is directly fixed to the back of the lining sheet 3 (see FIG. 16), the main switch 29, which protrudes upward, may be covered by a protective cover 31 made of a synthetic resin, etc., so that the waterproofing ability of the portion configuring the main switch 29 is improved.

Figure 24:
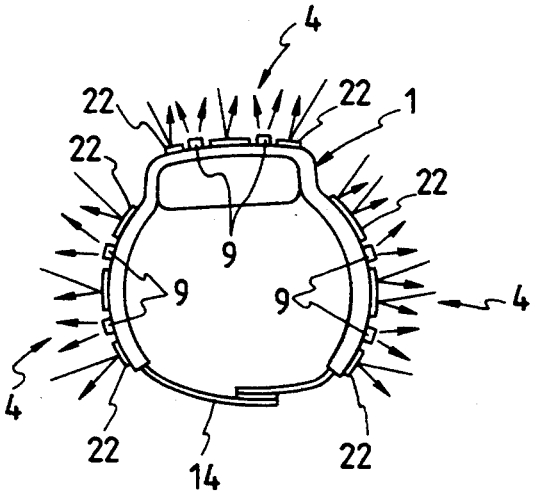
FIG. 24 is a plan view showing the inventive safety indicating device wound around a cylindrical portion of a human body, for example, an arm.

When the thus-configured safety indicating device is wound around a cylindrical portion of the arm or the like of the user, as shown in FIG. 24, the indicator body 1 causes the light emitting body 4 to arcuately disposed around an arc of 180 degrees along the shape of the attached object, so that light reflected from the reflectors 22 and light emitted by the LEDs 9 is radiated in the front, rear and side directions of the user. Accordingly, the visible range for drivers of vehicles can be widened to an angle of 180 degrees. Alternatively, as shown in 25, the belt 14 may be removed from the indicator body 1, and the user's trouser belt 33 may be inserted into the belt holders 7 formed on the back of the indicator body 1 to pass therethrough. In this case, the indicator body 1 is attached to the waist of the user by the belt 33.

Figure 26:
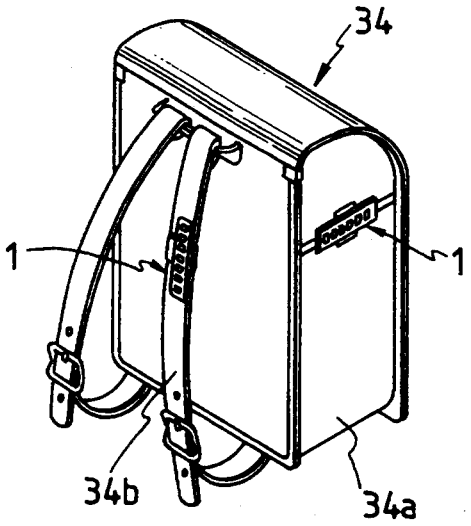
FIG. 26 is a perspective view showing the safety indicating device of the invention attached to a satchel.

As shown in FIG. 26, the device may be attached to a side portion 34*a* or a shoulder strap 34*b* of a satchel 34 for children. In such alternative cases, fixing means (not shown) such as Velcro tape is provided on the back or the peripheral portion of the indicator body 1. These attaching methods have an advantage that the user can move more freely as compared with the case where the device is attached to the wrist or arm, or, in other words, the attachment of the device does not hinder the movement of the user.

Figure 27:
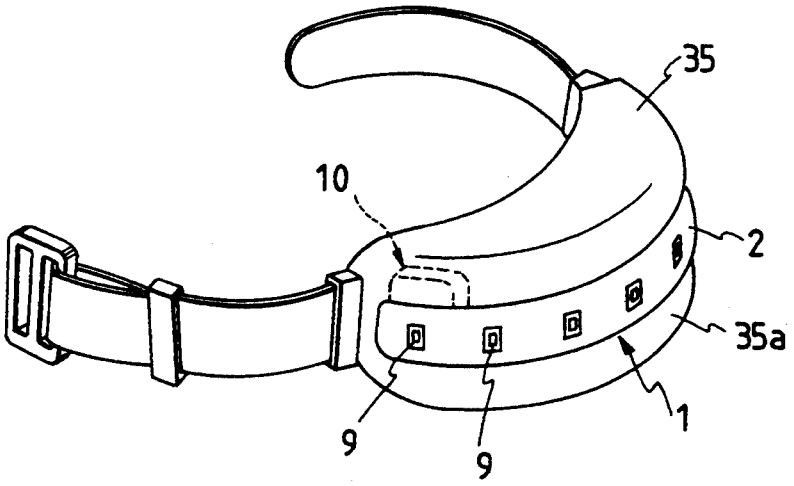
FIG. 27 is a perspective view showing the safety indicating device of the invention applied to a waist pack.
Figure 28:
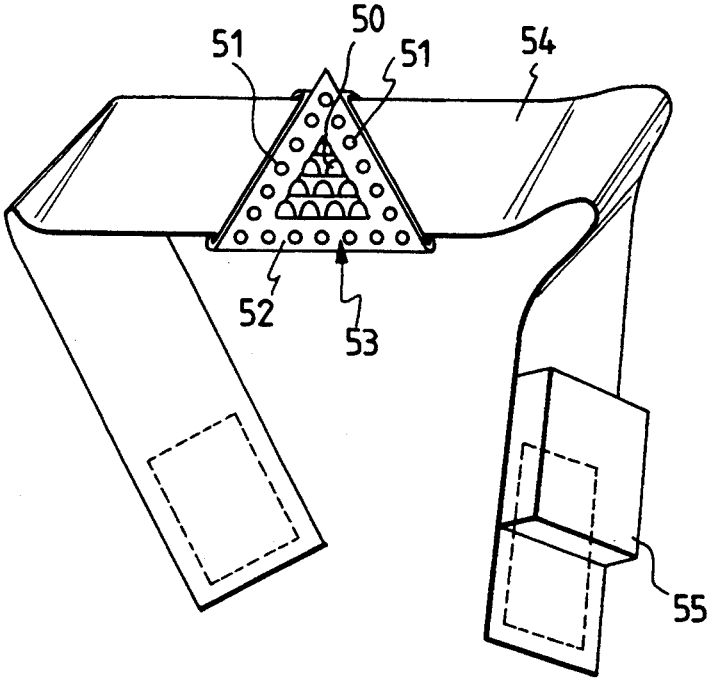
FIG. 28 is a perspective view showing a prior art safety indicating device.
Figure 29:
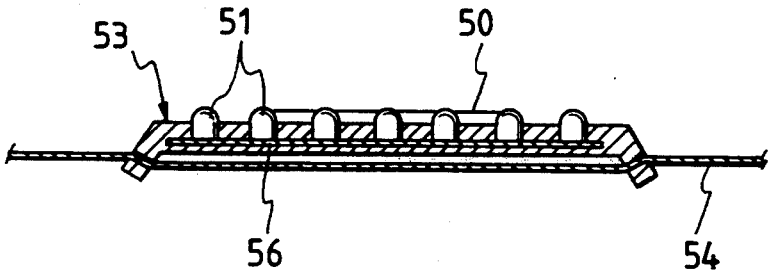
FIG. 29 is an enlarged sectional view of main portions of the prior art safety indicating device.

As shown in FIG. 27, the safety indicating device of the invention may be realized in the form of a waistbag 36. In this alternative, the indicator body 1 is fixed to the surface 35a of the waistbag 35, while the power source unit 10 is separated from the indicator body and disposed in the bag. According to this configuration, the indicator body 1 can be curved through an arc of 180 degrees along the surface 35*a* of the waistbag 35 so that visibility over a wide angle for drivers of vehicles is ensured.

Figure 25:
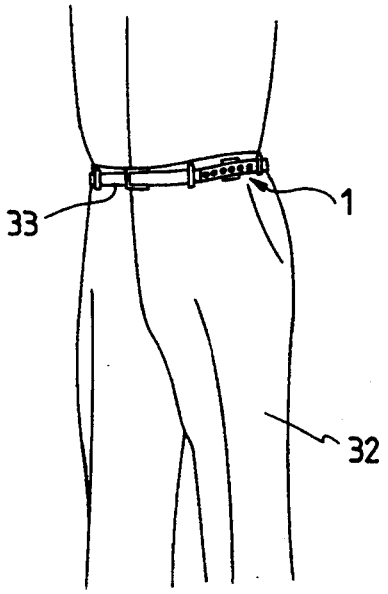
FIG. 25 is a perspective view showing the safety indicating device of the invention attached to a waist belt.

It is apparent to those skilled in the art that the method of attaching the safety indicating device of the invention is not restricted to the cases shown in FIGS. 25 to 27.

The safety indicating device of the invention having the above-described configuration can be attached to the wrist, arm or waist of the user emitting light in such a manner that the visibility for drivers of vehicles can be improved over a wide range. Accordingly, the safety indicating device of the invention can prevent an accident which might otherwise be caused by a vehicle passing in the vicinity of the user on the road, and contribute to road safety.

According to the safety indicating device of the invention, the visibility and attractiveness can be ensured and improved by fluorescence of the front cloth and the reflective action owing to the reflector. Even when the light emitting body is not actuated or does not emit light in rainy weather, it is possible to obtain a predetermined reflective visibility. Furthermore, the safety indicating device of the invention has a very simple structure, can be constructed by a simple method, and is inexpensive.

What is claimed is:

1. A safety indicating device comprising;

a flexible indicator body means comprising a plurality of LEDs emitting light toward a surface, and a power source unit for supplying electric power to said LEDs, said indicator body further comprising:

a front sheet having at least one window formed therein, and a flexible, transparent protective sheet disposed on a back side of said front sheet, said protective sheet having projections corresponding to said at least one window; and a flexible substrate disposed on a back side of said transparent protective sheet, said LEDs being fixedly arranged on said substrate at positions corresponding to said projections, said transparent protective sheet and said flexible substrate being stacked together, and a waterproof lining sheet closely adhered to a back side of said flexible substrate.

2. The safety indicating device according to claim 1, further comprising a belt holder and a belt for securing said indicator body to clothes of a body of a user passing through said belt holder, said belt holder being provided on a back side of said indicator body.

3. The safety indicating device according to claim 1, wherein said front sheet is formed of cloth.

4. The safety indicating device according to claim 1, wherein said front sheet is formed of a waterproof material.

5. The safety indicating device according to claim 4, wherein said front sheet is formed of a polyvinyl chloride sheet material.

6. The safety indicating device according to claim 1, wherein said waterproof lining sheet is formed of cloth.

7. The safety indicating device according to claim 1, wherein said waterproof lining sheet is formed of a waterproof material.

8. The safety indicating device according to claim 7, wherein said waterproof lining sheet is formed of a polyvinyl chloride sheet material.

9. The safety indicating device according to claim 1, wherein said at least one window comprises a plurality of windows.

10. The safety indicating device according to claim 1, wherein said at least one window comprises a single window surrounding two or more of said projections.

11. The safety indicating device according to claim 1, wherein said transparent protective sheet and said flexible substrate are adhered to each other.

12. The safety indicating device according to claim 1, wherein said transparent protective sheet is connected to said front sheet to form a unit therewith, and said unit is connected to said flexible substrate.

13. The safety indicating device according to claim 1, further comprising a trimming sheet for covering peripheral portions of said front sheet and said lining sheet so that said peripheral portions are sewn in a tubular state and said indicator body is hermetically sealed therein.

14. The safety indicating device according to claim 1, further comprising a fluorescent material applied to at least a surface of said front sheet.

15. The safety indicating device according to claim 1, wherein a predetermined pattern is formed on at least one surface of said front sheet.

16. The safety indicating device according to claim 1, wherein said front sheet and said lining sheet are made of a waterproof material.

17. The safety indicating device according to claim 16, wherein said waterproof material is a polyvinyl chloride sheet material.

18. The safety indicating device according to claim 1, wherein said projections of said transparent protective sheet cover said LEDs, and wherein said at least one window of said front sheet surrounds said projections.

19. The safety indicating device according to claim 2, wherein said belt comprises a buckle at one end of said belt, and fixing means at the other end of said belt.

20. The safety indicating device according to claim 19, wherein said fixing means comprises a Velcro tape.

21. The safety indicating device according to claim 1, wherein said at least one window opens at portions of said front sheet which correspond to said LEDs.

22. The safety indicating device according to claim 1, wherein said transparent protective sheet covering a surface of said flexible substrate is formed in to a shape in which portions corresponding to said at least one window project toward the surface of the device so that LEDs located inside said projections are exposed in said at least one window.

23. The safety indicating device according to claim 1, further comprising a reflector located inside said at least one window.

24. The safety indicating device according to claim 1, wherein said front sheet has a convex arcuate shape and is fixed to a back of a battery box having a concave arcuate shape.

25. The safety indicating device according to claim 1, further comprising a fixing means formed on said indicator body.

26. The safety indicating device according to claim 25, wherein said fixing means comprises a Velcro tape.

27. The safety indicating device according to claim 1, wherein said projections protrude through said at least one window of said front sheet.

* * * * *